US010251523B2

(12) United States Patent
Kauffman

(10) Patent No.: US 10,251,523 B2
(45) Date of Patent: Apr. 9, 2019

(54) ANTI-BACTERIAL TREATMENT DEVICE AND METHOD FOR A FLOOR CLEANING DEVICE

(71) Applicant: Pacific Steamex Cleaning Systems, Inc., Muskegon, MI (US)

(72) Inventor: Kipling J. Kauffman, Zeeland, MI (US)

(73) Assignee: Pacific Steamex Cleaning Systems, Inc., Muskegon, MI (US)

( * ) Notice: Subject to any disclaimer, the term of this patent is extended or adjusted under 35 U.S.C. 154(b) by 690 days.

(21) Appl. No.: 14/924,906

(22) Filed: Oct. 28, 2015

(65) Prior Publication Data

US 2016/0113456 A1 Apr. 28, 2016

Related U.S. Application Data

(60) Provisional application No. 62/069,599, filed on Oct. 28, 2014.

(51) Int. Cl.

| | |
|---|---|
| ***A47L 7/00*** | (2006.01) |
| ***A47L 11/30*** | (2006.01) |
| ***A47L 11/40*** | (2006.01) |

(52) U.S. Cl.

CPC ..... *A47L 11/4016* (2013.01); *A47L 7/0004* (2013.01); *A47L 7/0009* (2013.01); *A47L 7/0014* (2013.01); *A47L 7/0023* (2013.01); *A47L 7/0033* (2013.01); *A47L 7/0061* (2013.01); *A47L 11/30* (2013.01); *A47L 11/4022* (2013.01)

(58) Field of Classification Search

CPC .... A47L 7/0004; A47L 7/0009; A47L 7/0014; A47L 7/0023; A47L 7/0033; A47L 7/0061; A47L 11/30; A47L 11/4016; A47L 11/4022

USPC ..... 134/109, 110

See application file for complete search history.

(56) References Cited

U.S. PATENT DOCUMENTS

2011/0030743 A1* 2/2011 Grosman ..... A61L 2/22 134/56 R

2012/0096670 A1* 4/2012 Kim ..... A47L 9/02 15/339

OTHER PUBLICATIONS

Parts Manual, T5 Hygenic Fully Cleanable Tanks and QA Controls, Tennant Co., (www.tennantco.com), believed to have been published in Nov. 2010, see p. 16 item #21.

* cited by examiner

*Primary Examiner* — Levon J Shahinian

(74) *Attorney, Agent, or Firm* — Gardner, Linn, Burkhart & Ondersma LLP

(57) ABSTRACT

A floor cleaning device having an anti-bacterial treatment system includes a recovery tank configured to receive and retain waste cleaning liquid, a recovery hose in fluid communication with the recovery tank, and a vacuum system configured to draw waste cleaning liquid from a surface that is being cleaned through the recovery hose and into the recovery tank. An anti-bacterial material is located whereby at least some of the waste cleaning liquid discharged into the recovery tank passes over the anti-bacterial material. In a particular embodiment a debris trap assembly is positioned within the recovery tank such that waste cleaning liquid drawn through the recovery hose passes through the debris tray prior to discharging into the recovery tank, with the anti-bacterial material disposed at the debris tray.

19 Claims, 7 Drawing Sheets

ANTI-BACTERIAL TREATMENT DEVICE AND METHOD FOR A FLOOR CLEANING DEVICE

CROSS REFERENCE TO RELATED APPLICATION

The present application claims priority of U.S. provisional application Ser. No. 62/069,599 filed Oct. 28, 2104, which is hereby incorporated herein by reference in its entirety.

BACKGROUND OF THE INVENTION

The present invention is directed to an anti-bacterial treatment device and method for a floor cleaning device, such as a floor cleaner.

Floor scrubbers are used to clean floor surfaces and include a scrubber head that may be positioned against the floor to provide scrubbing action on the floor. An operator may walk behind the floor scrubber, with the scrubber head being movable between a raised orientation for transporting the floor scrubber when not being used for cleaning, and the noted cleaning orientation in which the scrubber head is positioned against the floor.

Different types of scrubber heads may be mounted to a floor scrubber, including a rotary scrubber head in which the pad is circularly rotated against the floor surface and an orbital scrubber head in which the pad is moved against the floor in an eccentric manner without completely spinning. In the case of orbital scrubber heads, cleaning fluid is discharged to enable the floor to be cleaned by the scrubber head. The cleaning fluid is then worked against the floor surface by the pad of the scrubber head. Finally, the cleaning fluid, now waste liquid, along with any debris on the surface is collected from the surface by a waste liquid recovery system and discharged into the floor cleaning device. Specifically, the waste liquid and debris is generally collected into a recovery tank and held until it is later emptied into a drain. The recovery tanks may include a debris tray such that any solid debris that is drawn up from the floor is captured in the debris tray to thereby separate the solids from the waste cleaning liquid.

Alternative floor cleaning devices likewise utilize liquid cleaning solutions, where the excess or waste liquid cleaning solutions must then be removed from the floor surface, such as be extractors, including extractors utilizing a hand held wand.

SUMMARY OF THE INVENTION

The present invention provides an anti-bacterial treatment device and method for operating a floor cleaning device.

According to an aspect of the present invention, a floor cleaner for scrubbing floor surfaces includes a waste liquid recovery assembly including a water recovery hose in fluid communication with a recovery tank. A debris tray is disposed in the recovery tank, such as above a recovery water line, with the debris tray configured to capture solid objects drawn up through the waste water recovery hose. The recovery tank receives waste liquid collected by the waste liquid recovery assembly through a liquid discharge opening through the recovery hose. In a particular embodiment, an anti-bacterial assembly has a retention cap with perforations and a plurality of retention arms to removably engage the cap to the debris tray, with the retention cap secures an anti-bacterial member to the debris tray, and is selectively in fluid communication with the waste liquid drawn up through the recovery hose and discharged into the recovery tank.

A method of operating the floor cleaning device includes collecting liquid waste from the surface by the floor cleaning device, where the waste liquid may include solid debris. Waste liquid is communicated to a debris tray disposed in the recovery tank, with the anti-bacterial material being disposed proximate to the location at which the liquid is discharged into the recovery tank whereby the waste liquid passes over the anti-bacterial material.

The anti-bacterial cleaning device in accordance with the present invention inhibits bacterial growth in the waste liquid and promotes anti-bacterial qualities within the floor cleaning device that may cause undesirable odors. The anti-bacterial cleaning device also reduces the setup and cleanup time of the floor scrubbing, thus the floor cleaning device's effectiveness and efficiency is improved.

These and other objects, advantages, purposes and features of this invention will become apparent upon review of the following specification in conjunction with the drawings.

DESCRIPTION OF THE PREFERRED EMBODIMENTS

Figure 1:
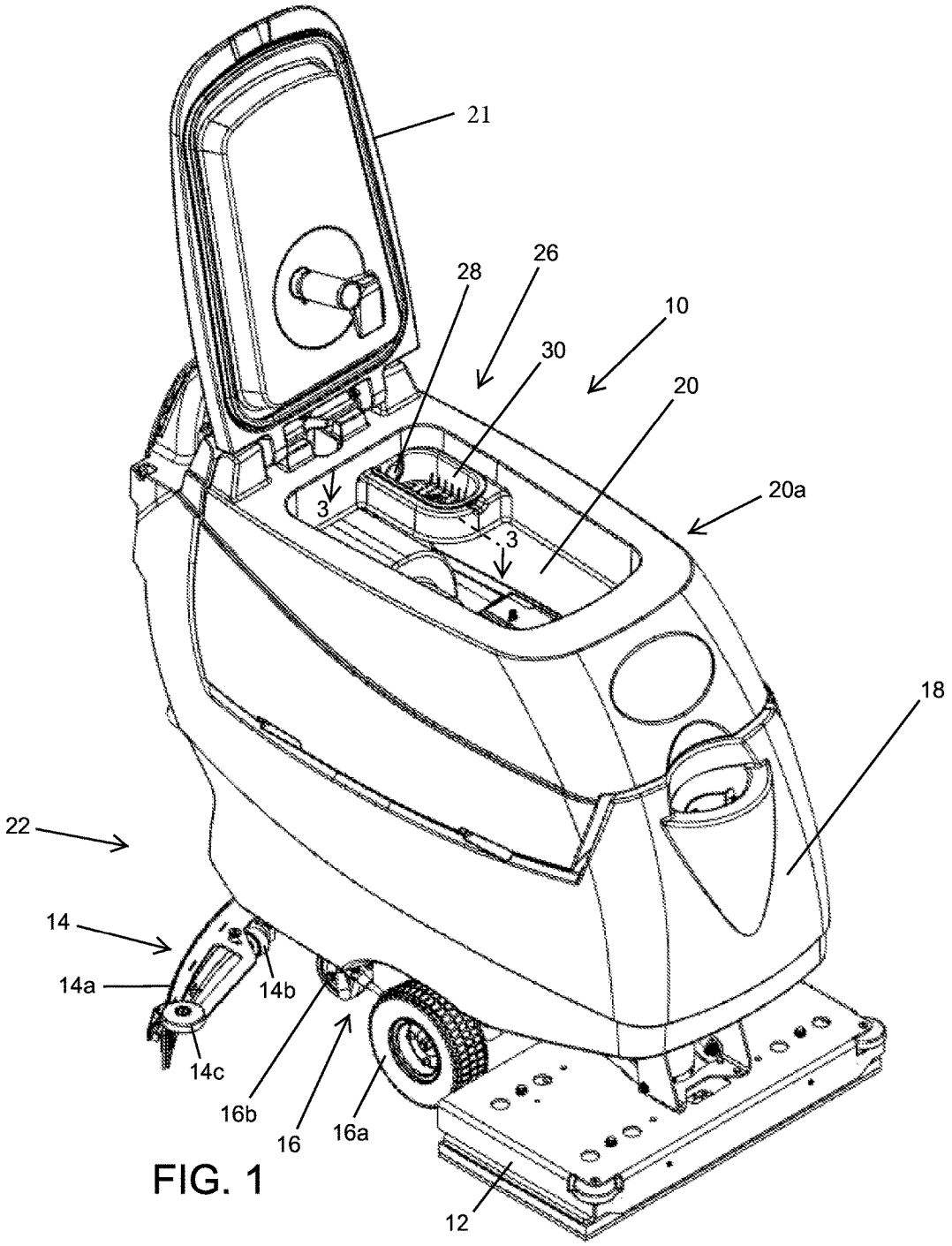
FIG. 1 is a perspective view of a floor cleaning device including an anti-bacterial treatment device.

The present invention will now be described with reference to the accompanying figures, wherein the numbered elements in the following written description correspond to like-numbered elements in the figures. A floor cleaning device 10 with a scrubber head 12 for cleaning floors is shown in FIG. 1, in which the floor cleaning device 10 includes a liquid recovery assembly configured as a squeegee assembly 14 and is an operator walk-behind type scrubber having a base assembly 16 with forward wheels 16*a* and rear wheels 16*b* for supporting movement of scrubber head 12 on a floor or surface, as well as various tanks, such as a water holding tank 18 and a recovery tank 20, for providing cleaning fluid and retaining used fluid from the floor, respectively, with a lid 21 disposed for closing tank 20 and with the scrubber head 12 being joined to the base assembly 16.

Floor cleaning device 10 includes a waste liquid recovery system 22, which includes a waste liquid recovery tube or hose 24, which may be rigid or flexible, that is in fluid communication with the recovery tank 20 and a debris trap assembly, which in the illustrated embodiment comprises a debris tray assembly 26 at a first end 24*a* of hose 24, with a second end 24*b* (FIG. 6) of hose 24 in fluid communication with the squeegee assembly 14, where the end 24*b* thus comprises a suction head at squeegee assembly 14. In the illustrated embodiment, debris tray assembly 26 is positioned at an upper portion of recovery tank 20. A vacuum pump system 15 (FIG. 6) is used to generate a vacuum pressure within recovery tank 20 to draw the used cleaning fluid off the floor surface being cleaned through hose 24, with the cleaning fluid being discharged from end 24*a* of hose 24 into recovery tank 20 through an opening 25 (FIG. 4) at recovery tank 20 and with debris tray assembly 26 retaining any solid debris drawn up with the cleaning fluid to thereby inhibit such debris from being discharged into tank 20. The floor cleaning device 10 is thus capable of cleaning a floor with the cleaning fluid from the scrubber head 12, collecting the cleaning fluid and debris from a floor with the squeegee assembly 14 as waste, and directing the waste to the recovery tank 20. As shown in FIG. 1 and discussed in more detail below, an anti-bacterial assembly 34 is disposed in the tray assembly 26, with assembly 34 including an anti-bacterial member or material 38 such that at least some of the waste liquid discharged from hose 24 flows over anti-bacterial material 38. Anti-bacterial material 38 in turn dissolves when contacted by the waste liquid discharged from hose 24 to provide anti-bacterial treatment to the waste liquid within recovery tank 20 and thereby inhibit bacterial growth therein.

The squeegee assembly 14 of the waste liquid recovery assembly 22 is located adjacent the floor surface that is being cleaned and is in fluid communication with the waste liquid recovery hose 24. The squeegee assembly 14 is generally disposed behind the scrubber head 12, opposite the direction of travel of the floor cleaning device 10. The squeegee assembly 14 may include a concave, curved squeegee 14*a* that is in contact with the floor to collect and direct liquid waste via a vacuum pump system 15 to the first end 24*a* of the waste liquid recovery hose 24. The squeegee assembly 14 may also have at least one base wheel 14*b* that rolls on a floor or at least one guide wheel 14*c* that rolls along a vertical surface, such as a wall or stair (not shown). The squeegee assembly 14 may also shift or pivot about a vertical axis of the squeegee assembly 14, for example when a guide wheel 14*c* contacts a wall. Alternative assemblies for collecting and/or directing used cleaning liquid to a recovery hose may be employed within the scope of the present invention, including alternative floor cleaning devices.

Figure 3:
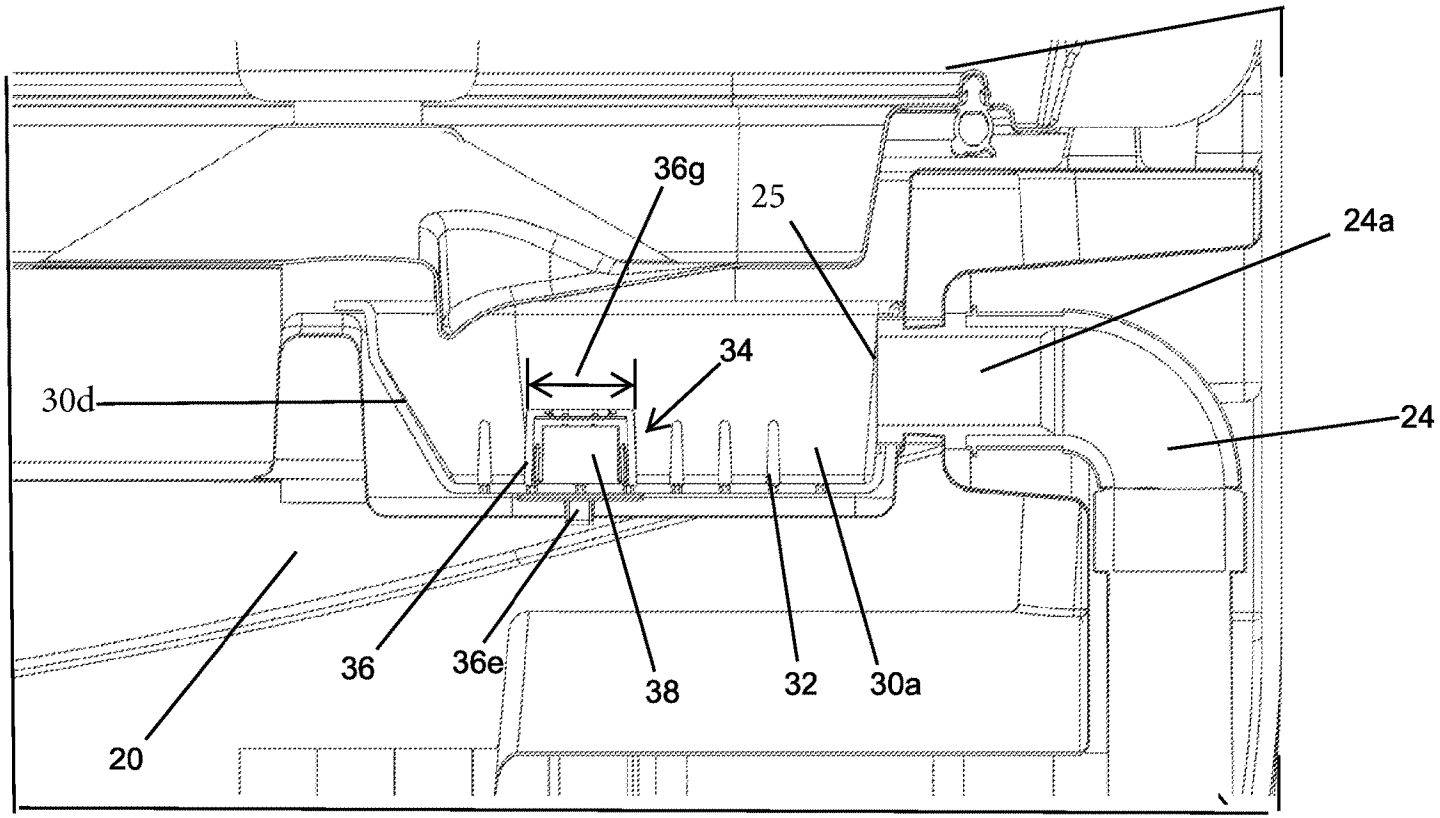
FIG. 3 is a partial side sectional view of a debris tray assembly in fluid communication with a water recovery hose within the floor cleaning device of FIG. 1.
Figure 6:
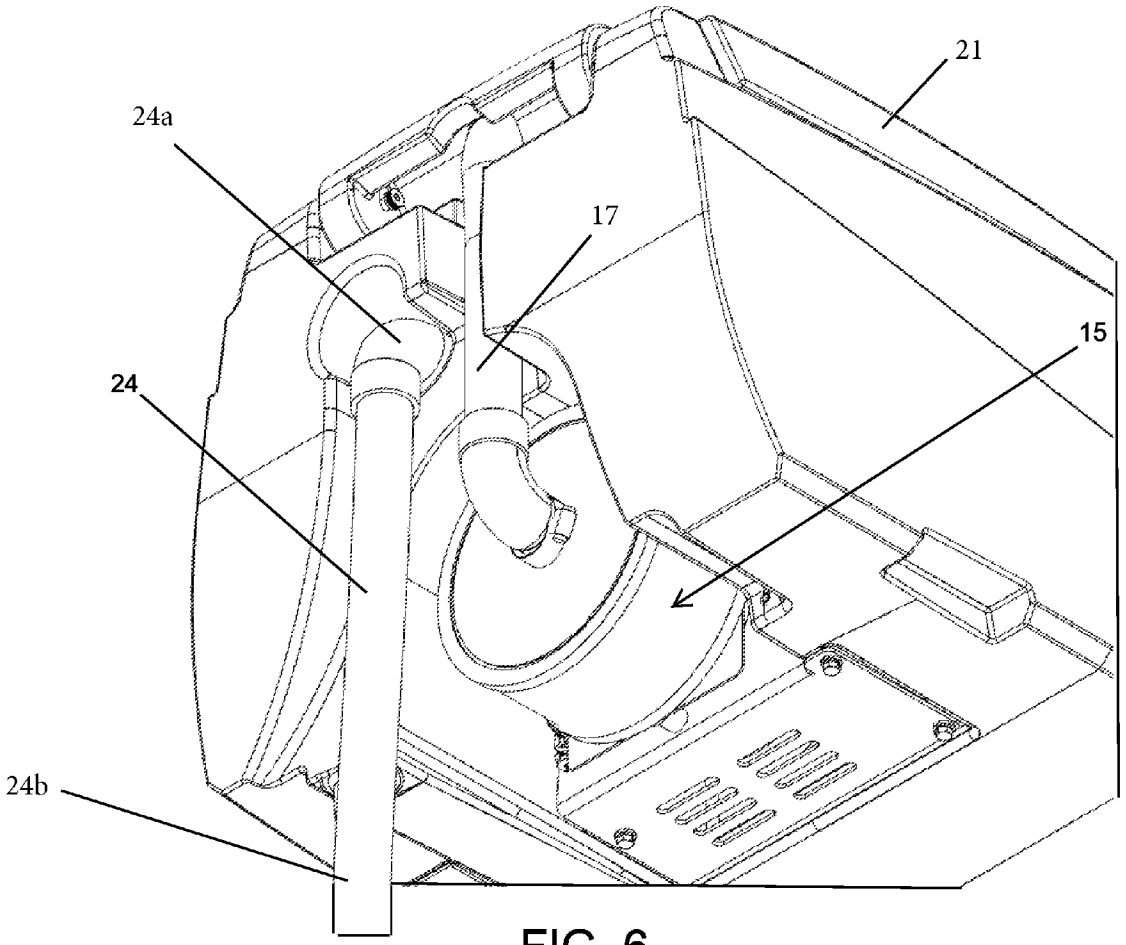
FIG. 6 is a partial rear perspective view of a tank portion of the cleaning device of FIG. 1 disclosing the vacuum system of the cleaning device.

Referring to FIGS. 3 and 6, the waste liquid recovery hose 24 extends between a second end 24*b*, which is disposed adjacent to the squeegee assembly 14, and the first end 24*a*, which is disposed adjacent to the debris tray assembly 26. Specifically, the first end 24*a* of the waste liquid recovery hose 24 is aligned with a liquid discharge opening 28 of the debris tray assembly 26, such as shown in the illustrated embodiment. The waste liquid recovery hose 24 may use common mechanisms for raising water from the first end 24*a* to the second end 24*b*, such as the vacuum system 15 shown in FIG. 6, which includes a vacuum line or hose 17 extending into the interior of recovery tank 20.

As shown in FIGS. 2-5, the debris tray assembly 26, or debris trap assembly, is disposed adjacent to a top section 20*a* of the recovery tank 20 of the floor cleaning device 10. The debris tray assembly 26 is positioned such that waste liquid and any debris therein is drawn through the waste recovery hose 24 and passes into the debris tray assembly 26 prior to the liquid portion discharging into the recovery tank 20. The debris tray assembly 26 includes a debris tray 30 and a debris tray holder 32 that may be fixed to the recovery tank 20. However, the debris tray 30 may be removable from the recovery tank 20.

Figure 2:
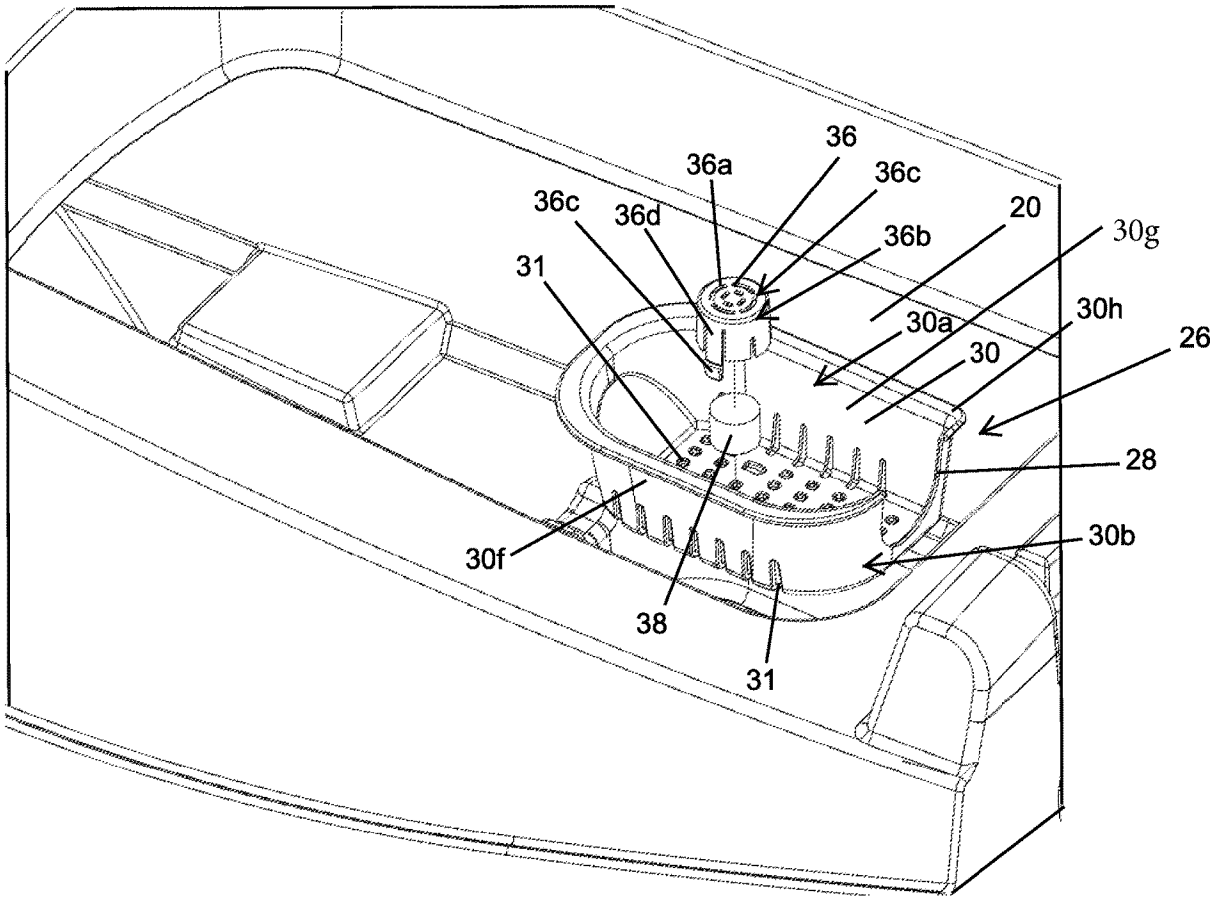
FIG. 2 is a partial exploded perspective view of a debris tray assembly and an upper portion of the floor cleaning device of FIG. 1.
Figure 4:
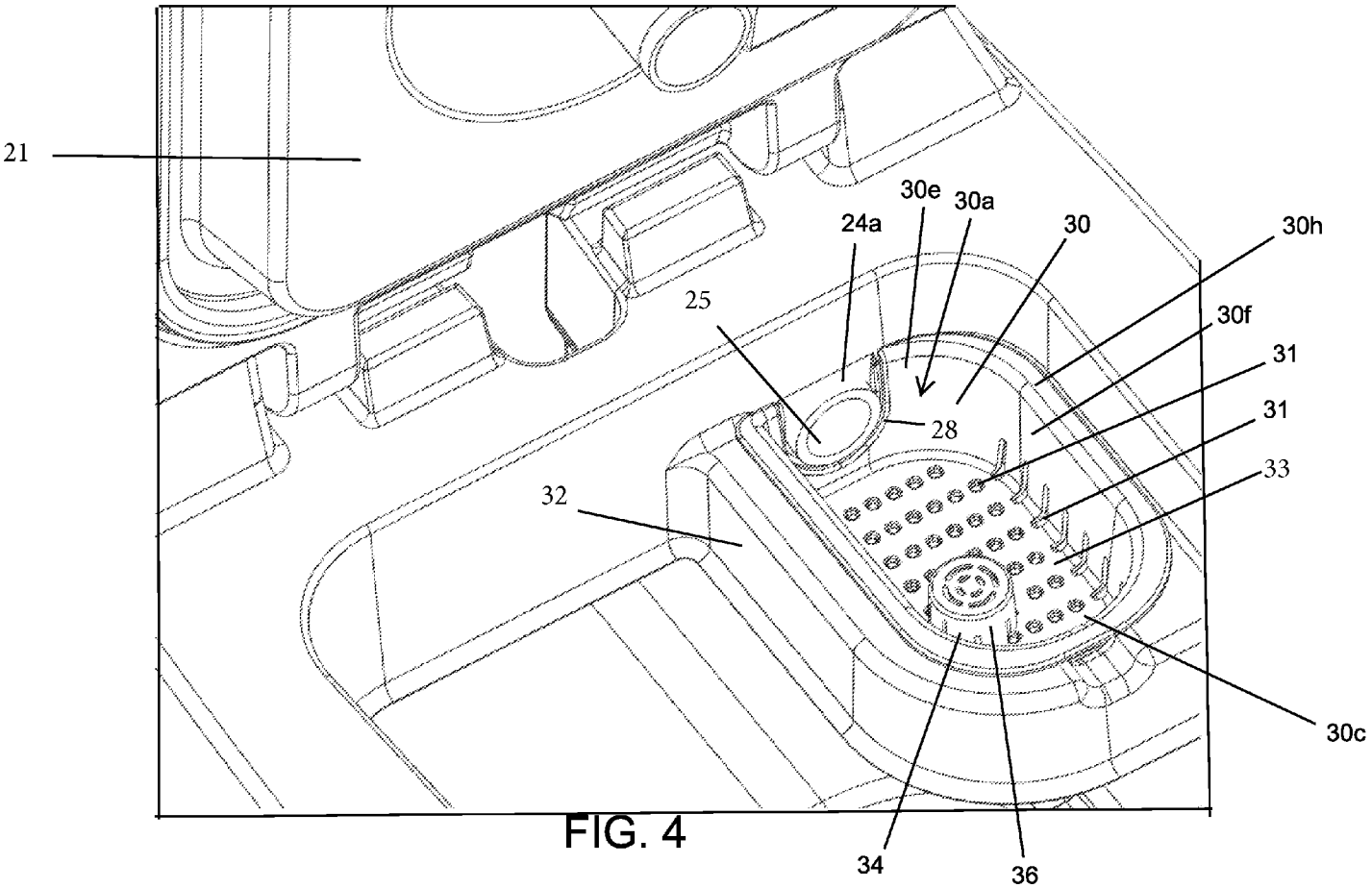
FIG. 4 is a partial perspective view of the top portion of the floor cleaning device showing the debris tray assembly therein.

In the figures, specifically FIGS. 2 and 4, the debris tray 30 generally has an oblong, bowl-like shape forming a screen portion 33 configured to retain debris, with an inner side 30*a* and an outer side 30*b* (FIG. 5), and is formed to fit within the debris tray holder 32. For example, the debris tray 30 may have an open top and a perforated bottom 30*c* that have a generally rectangular shape. Tray 30 includes an open end or wall 30*e* with a cutout forming the liquid discharge opening 28 that aligns with the waste liquid recovery hose 24, and an opposing end or wall 30*d*. The liquid discharge opening 28 may have a shape that allows the first end 24*a* of the waste liquid recovery hose 24 to fit flush with the debris tray 30. For example, the liquid discharge opening 28 may have a U-like shape, wherein a radius of the liquid discharge opening 28 is slightly larger than a radius of the first end 24*a* of the waste liquid recovery hose 24.

The debris tray 30 also has opposing sides or wall 30*f*, 30*g* extending between the end wall 30*e* and opposing end wall 30*d*. Alternative configurations may be employed including, for example, a debris tray having a bottom and open top that have a circular shape, with an opening for a liquid discharge opening. It should be appreciated that the debris tray assembly 26 may be sized in proportion to the recovery tank 20 of the floor cleaning device 10. For example, a larger floor cleaning device 10 may have a larger recovery tank 20, therefore, the debris tray assembly 26 may also be larger. A person having ordinary skill in the art understands that the debris tray 30 may have different shapes and sizes.

The debris tray 30 includes a plurality of apertures or perforations 31 between the inner side 30*a* and the outer side 30*b*, to form a screen portion or perforated wall portion. In the illustrated embodiment the perforations 31 are disposed on the bottom 30*c*, end walls 30*e* and 30*d*, and side walls 30*f*, 30*g*. Alternatively however, the perforations may be disposed on selected one or ones of the various walls and/or bottom portion. The perforations may also be alternatively shaped, for example, the perforations may be generally square, round, rectangular, or other shapes. Furthermore, the perforations may have different sizes and placements. For example, the perforations may be on more than one side of the debris tray 30. However, generally, the debris tray perforations 31 are positioned on the bottom 30*c* of the debris tray 30 and are sized such that debris drawn up with the waste cleaning liquid is generally prohibited from reaching the recovery tank 20. Generally, the perforations 31 are uniform and have a repeating pattern. However, a person having ordinary skill in the art understands that perforations 31 may have varied size, placement, and shape.

As noted, an anti-bacterial assembly 34 is located at or connected with the debris tray, with the anti-bacterial assembly including a cap 36 and an anti-bacterial member or material 38 in the illustrated embodiment. The cap 36 and the anti-bacterial member 38 may have a cylindrical-like shape, with a radial side 36*b* and an axial end 36*c*. The cap 36 may have cap perforations 36*a* and a securing or retention member, such as one or more retention arms 36*d*, to removably engage the cap 36 to the debris tray 30. The cap 36 also secures the anti-bacterial member 38 between a cavity of the cap 36 and the debris tray 30. The cap 36 may be removed from the debris tray 30, for example, to replace the anti-bacterial member 38. The cap perforations 36*a* may have varied shapes and sizes, like the perforations 31 of the debris tray 30. The cap perforations 36*a* may follow the curvature of the cylindrical shape of the cap 36, but may be sized to regulate fluid communication of the waste liquid to the anti-bacterial member 38.

The anti-bacterial member or material 38 has anti-bacterial properties that inhibits bacterial growth in the waste liquid. Specifically, the anti-bacterial material 38 may be a solid material that is substantially formed from a bromine compound or a chlorine compound. Therefore, the anti-bacterial member 38 may be an anti-bacterial tablet or cake or puck, for example. The anti-bacterial member 38 dissolves upon liquid flowing there over such that the anti-bacterial material is dissolved into the waste cleaning fluid retained in recovery tank 20 to inhibit bacterial growth in the waste cleaning fluid and recovery tank 20, as well as in or on any other portions of cleaning device 10 that contact the waste cleaning fluid, such as drain lines and the like. Therefore, the anti-bacterial member 38 may be periodically replaced. A person having ordinary skill in the art understands that other compounds and forms may be used as the anti-bacterial member 38. For example, the anti-bacterial member 38 may be formed of a bio-degradable material or enzyme material.

Figure 5:
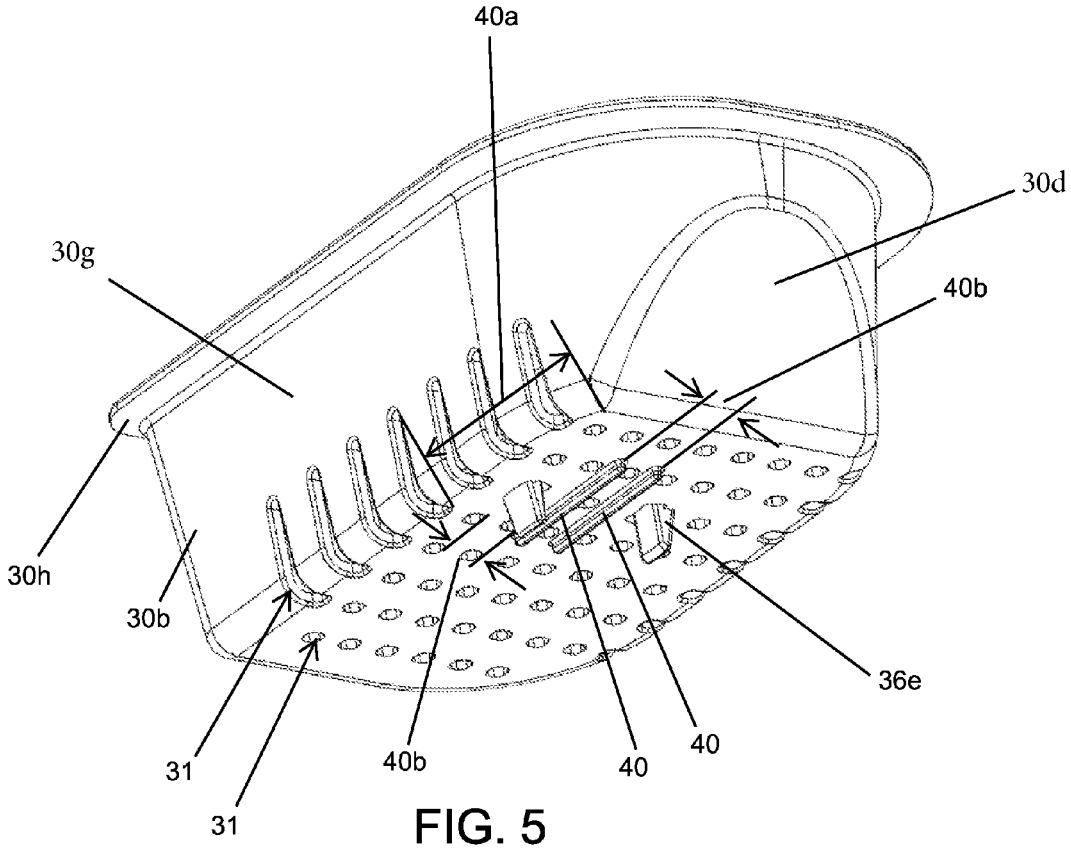
FIG. 5 is a bottom perspective view of the debris tray removed from the floor cleaning apparatus showing a rib and retention arms of a cap.

As understood from FIG. 5, the debris tray 30 may have a prevention member to prevent securing the cap 36 to an incorrect side of the debris tray 30, specifically in the illustrated embodiment the underside or outer side 30*b* of the screen portion. In the illustrated embodiment the prevention member comprises protrusions or projections formed as at least one rib 40 on the outer side 30*b* that is configured to prevent securing an anti-bacterial member 38 to the outer side 30*b*. Specifically, a pair of ribs 40 are formed as elongated protrusions with a length 40*a* greater than a width 36*g* of the cap 36 and a thickness 36*f* that is substantially similar to a thickness 40*b* of a tab 36*e* at the end of the retention arm 36*d*. Therefore, the rib 40 touches the cap 36 along the width 36*g* of the cap 36 and prevents the tab 36*e* from properly engaging with the debris tray 30. Furthermore, the rib 40 may be shaped or positioned on the debris tray 30 to avoid covering the perforations of the debris tray 30. The prevention member thus prohibits the cap 36 from being secured to the incorrect side of debris tray 30 to prevent the water line of the waste cleaning fluid in the tank 20 from rising above the anti-bacterial member 38. That is, the anti-bacterial member 38 is prevented from being submerged in the waste cleaning fluid. It should be appreciated that, depending on the floor cleaning device 10 and recovery tank 20, the cap 36 may be desired to be connected to an alternative location, such as an alternative location on the debris tray 30, whereby prevention members may be alternatively located to prevent improper assembly of cap 36.

Referring to FIGS. 1-5, and as discussed above, in the illustrated embodiment the anti-bacterial member 38 is secured between the cap 36 and the inner side 30*a* of the debris tray 30 via retention arms 36*d*. The retention arms 36*d* may be substantially uniformly dispersed around the cap 36. For example, two retention arms 36*d* on the cap 36 may oppose each other. The retention arms 36*d* engage with the perforations 31 of the debris tray 30. The retention arms 36*d* may be biased such that they engage with tray 30 through the perforations 31 to secure the cap 36 to the debris tray 30. Specifically, each retention arm 36*d* may have a tab 36*e* that snaps or frictionally engages with the debris tray 30, with the tabs 36*e* defining a shoulder for engaging with or contacting the debris tray 30 when passed through the perforations 31. Furthermore, the anti-bacterial member 38 is selectively in fluid communication with the waste liquid through the cap perforations 36*a*. However, generally, the perforations are sized such that debris in the waste liquid is unable to reach the anti-bacterial material 38, with the material 38 being retained within the cap 30. Although cap 30 is shown as having a generally cup-shaped construction, with anti-bacterial material 38 having a generally cylindrical shape to fit within the cavity of cap 30, it should be appreciated that alternative shapes and configurations of the cap and/or anti-bacterial material may be provided within the scope of the present invention.

The anti-bacterial member 38 is disposed in communication with a flow path of the waste cleaning fluid. For example, the anti-bacterial member 38 may be disposed on an opposite end of the inner side 30*a* of the debris tray 30 from the liquid discharge opening 28. However, a person having ordinary skill in the art understands that the anti-bacterial member 38 may be disposed at an adjacent end of the inner side 30*a* of the debris tray 30 from the liquid discharge opening 28. Therefore, the waste liquid selectively passes through the perforations of the cap 36 and, furthermore, is selectively in fluid communication with the anti-bacterial member 38.

The open top of the debris tray 30 includes a curved lip member 30*h* that extends around a perimeter of the debris tray 30. The curved lip member 30*h* may be formed by curving the inner side 30*a* and the outer side 30*b* of the debris tray 30 to form a lip 30*h* to rest the debris tray 30 onto the debris tray holder 32. The curved lip member 30*h* may extend around the perimeter continuously or with openings. For example, the curved lip member 30*h* may have an opening at the open end 30*e* of the debris tray 30 for the liquid discharge opening 28.

The debris tray assembly 26 is disposed in the recovery tank 20. Specifically, the debris tray 30 is disposed above a recovery water line of the recovery tank 20. The recovery tank 20 may have a varied shape and capacity. For example, the capacity of the recovery tank 20 may be substantially similar as a capacity of the water holding tank 18. Therefore, for example, the recovery tank 20 may reach a full level when the water holding tank 18 is substantially empty. The recovery water line is a line on the recovery tank that the waste liquid reaches when recovery tank 20 reaches the full level.

The recovery tank 20 is configured to receive and retain waste collected by the waste liquid recovery assembly 22 through the waste liquid recovery hose 24, the liquid discharge opening 28, and the debris tray assembly 26. The waste liquid may be removed from the recovery tank 20 by common means, such as a drain hose. Furthermore, the debris from the debris tray 30 may be removed by removing the debris tray 30 from the debris tray assembly 26 or by removing the debris manually with the debris tray 30 in the floor cleaning device 10. In addition, the anti-bacterial assembly 34 may remain engaged to the debris tray 30 while removing debris.

According to an aspect of the present invention, a method of operating the floor cleaning device 10 includes collecting waste from a surface by the floor cleaning device 10. The waste includes waste liquid and debris. Collecting the waste may be completed by the waste liquid recovery assembly 22, including the squeegee assembly 14 adjacent the floor.

The waste liquid recovery assembly 22 communicates the waste liquid to the debris tray assembly 26, specifically the debris tray 30, by the waste liquid recovery hose 24. Communicating the waste liquid to the debris tray 30 includes drawing the waste liquid from the surface being cleaned, where the drawing may be by accomplished via various mechanisms, such as a pump or vacuum system (FIG. 6). The debris tray 30 is disposed above the recovery water line of the recovery tank 20 within the floor cleaning device 10.

The debris tray assembly 26 selectively communicates the waste liquid through the perforations 36*a* of the cap 36 to the anti-bacterial member 38. Furthermore, the waste liquid may interact with the anti-bacterial member 38. Specifically, the waste liquid may interact with a bromine compound or a chlorine compound comprising the anti-bacterial member 38.

The cap 36, which may be a retention member forming a cavity, is removably engaged to the debris tray, specifically the screen portion, by the retention arms 36*d*. The cap 36 substantially encloses and holds the anti-bacterial member 38 to allow selective fluid communication when the retention member is attached to the screen portion. In addition, the cap 36 substantially restricts motion of the anti-bacterial member 38.

Furthermore, the debris tray perforations 31 selectively communicate waste liquid to the recovery tank 20. For example, selectively communicating the waste liquid through the perforations 31 may be gravity fed. A person having ordinary skill in the art understands that the floor cleaning device 10 may also use a pump or vacuum system to force waste liquid through the debris tray perforations 31.

In addition, the debris tray 30 retains debris in the debris tray 30. Specifically, the debris tray 30 retains debris that is larger than the perforations 31. The retained debris is removed from debris, for example, when operation for the floor cleaning device 10 is complete. For example, the debris from the debris tray 30 may be removed by removing the debris tray 30 from the debris tray assembly 26 or by removing the debris manually with the debris tray 30 in the floor cleaning device 10. In addition, the anti-bacterial assembly 34 may remain engaged to the debris tray 30 while removing debris.

Figure 7:
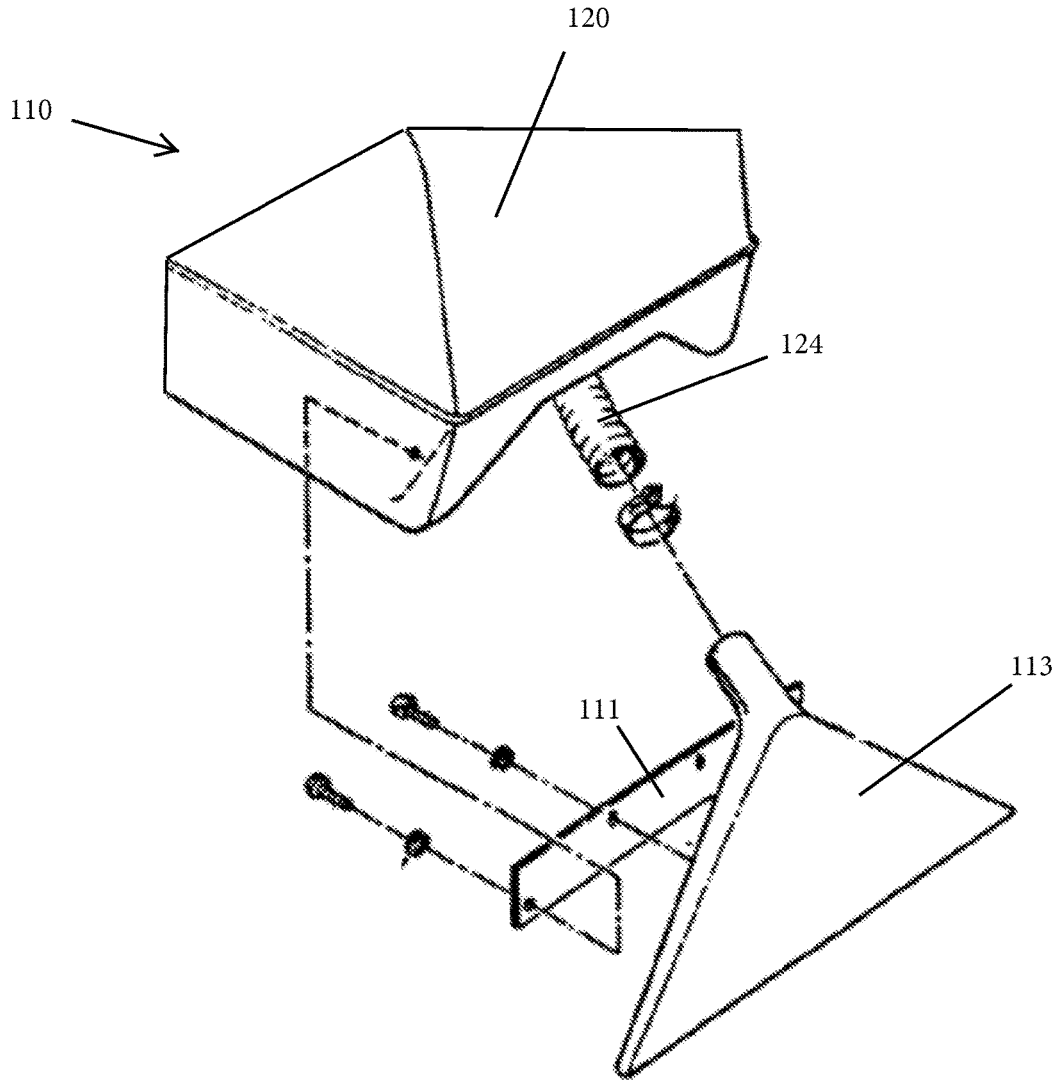
FIG. 7 is a partial perspective view of an alternative floor cleaning device with a recovery tank and an alternative liquid waste recovery assembly.

FIG. 7 illustrates an alternative floor cleaning device configured as an extractor 110, where the extractor includes a recovery tank 120 and an alternative liquid recovery assembly 114 that includes a suction head 113 that is attachable to a hose 124. In the illustrated embodiment suction head 113 is configured as a conventional extractor shoe that includes a narrow slit through which waste liquid cleaning solution is vacuumed into tank 120, with a support member in the form of a bar or blade 111 mounted to suction head 113. Tank 120 is likewise configured to include a debris trap assembly, such as debris tray assembly 26 with debris tray 30 as disclosed above that is positioned adjacent an internal opening through which liquid waste is discharged into tank 120. Although not shown, extractor 110 further includes a vacuum system and wheels for supporting and moving extractor 110. It should be appreciated that alternative floor cleaning devices configured as extractors may be employed with the present invention, including conventional tank extractors configured with a handheld wand that includes a spray jet, vacuum and shoe, but do not include a floor cleaning brush. Still further, it should be additionally appreciated that the present invention may be employed with still alternative floor cleaning devices that are configured to draw waste cleaning liquid into a recovery tank.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A floor cleaning device having an anti-bacterial treatment system, said floor cleaning device comprising:

a recovery tank for receiving and retaining waste cleaning liquid, said recovery tank including a tank opening at an upper portion of said recovery tank;

a recovery hose in fluid communication with said recovery tank through said tank opening;

a vacuum system, said vacuum system operable to draw waste cleaning liquid from a surface through said recovery hose and into said recovery tank;

a debris trap assembly, said debris trap assembly positioned at the upper portion of said recovery tank at said tank opening and comprising a perforated debris tray such that waste cleaning liquid drawn through said recovery hose passes through said debris tray and into said recovery tank;

said debris trap assembly including a water soluble solid anti-bacterial material disposed at said debris tray, said anti-bacterial material located whereby at least some of the waste cleaning liquid discharged into said recovery tank passes over said anti-bacterial material.

2. The floor cleaning device of claim 1, wherein said anti-bacterial material is retained at said debris tray.

3. The floor cleaning device of claim 1, further including a retention member and wherein said anti-bacterial material is held at said debris trap assembly by said retention member to inhibit said anti-bacterial material from escaping from said debris trap assembly.

4. The floor cleaning device of claim 3, wherein said retention member comprises a cap defining a cavity, and wherein said anti-bacterial material is disposed within said cavity.

5. The floor cleaning device of claim 4, wherein said cap includes a retention arm with said retention arm being attachable to said debris trap assembly.

6. The floor cleaning device of claim 5, wherein said wherein said retention arm is securable to an aperture of said debris tray.

7. The floor cleaning device of claim 1, further comprising a holding tank from which cleaning liquid is released for dispensing onto a surface to be cleaned, a squeegee assembly, a floor cleaning head and wheels, wherein said wheels enable said floor cleaning device to be moved over the surface to be cleaned and said squeegee assembly is configured to collect waste cleaning liquid from the surface, and wherein said recovery hose is in fluid communication with said squeegee assembly with said vacuum system configured to draw waste cleaning liquid collected by said squeegee assembly.

8. A floor cleaning device having an anti-bacterial treatment system, said floor cleaning device comprising:

a recovery tank for receiving and retaining waste cleaning liquid;

a recovery hose in fluid communication with said recovery tank;

a vacuum system, said vacuum system operable to draw waste cleaning liquid from a surface through said recovery hose and into said recovery tank;

an opening at an upper portion of said recovery tank through which waste cleaning liquid drawn up by said vacuum system through said recovery hose discharged into said recovery tank; and a water soluble solid anti-bacterial material, said anti-bacterial material disposed proximate said opening whereby at least a portion of waste cleaning liquid discharged from said opening passes over said anti-bacterial material.

9. The floor cleaning device of claim 8, further including a debris tray, and wherein said debris tray is disposed in said recovery tank and at an upper portion of said recovery tank whereby waste cleaning liquid drawn up by said vacuum system through said recovery hose is configured to be discharged into said debris tray.

10. The floor cleaning device of claim 9, wherein said anti-bacterial material is disposed at said debris tray.

11. The floor cleaning device of claim 10, wherein said anti-bacterial material is retained to said debris tray.

12. The floor cleaning device of claim 11, wherein said anti-bacterial material comprises a water soluble bromine compound or a water soluble chlorine compound.

13. The floor cleaning device of claim 9, further including a retention member and wherein said anti-bacterial material is held to said debris tray by said retention member.

14. The floor cleaning device of claim 13, wherein said retention member comprises a cap defining a cavity, and wherein said anti-bacterial material is disposed within said cavity.

15. The floor cleaning device of claim 14, wherein said cap includes a retention arm with said retention arm being attachable to an aperture of said debris tray.

16. A floor cleaning device having an anti-bacterial treatment system, said floor cleaning device comprising:

a recovery tank, said recovery tank configured to receive and retain waste cleaning liquid;

a recovery hose in fluid communication with said recovery tank;

a vacuum system, said vacuum system configured to draw waste cleaning liquid from a surface through said recovery hose and into said recovery tank;

a debris trap assembly, said debris trap assembly including a debris tray having a plurality of apertures there through with said debris tray positioned such that waste cleaning liquid drawn through said recovery hose passes through said debris tray prior to discharging into said recovery tank;

a retention cap and a water soluble solid anti-bacterial material, said retention cap securing said anti-bacterial material to said debris trap assembly with said anti-bacterial material is-located whereby at least some of the waste cleaning liquid discharged into said recovery tank passes over said anti-bacterial material;

wherein said floor cleaning device includes a suction head in fluid communication with said recovery hose and configured to be moved over a surface to be cleaned with said vacuum system configured to draw waste cleaning liquid through said suction head.

17. The floor cleaning device of claim 16, wherein said retention cap includes a plurality of perforations and defines a cavity and wherein said anti-bacterial material is disposed within said cap.

18. The floor cleaning device of claim 17, wherein said cap includes a plurality of retention arms and wherein said retention arms are securable to said apertures of said debris tray.

19. The floor cleaning device of claim 18, wherein said retention arms each include a tab disposed at an end of said retention arms, and wherein said tabs engage with said debris tray through said apertures to affix said cap to said debris tray.

* * * * *